US009388749B2

(12) United States Patent
MacDonald

(10) Patent No.: US 9,388,749 B2
(45) Date of Patent: Jul. 12, 2016

(54) SYSTEM AND METHOD FOR IMPROVING PERFORMANCE OF COMBUSTION ENGINES EMPLOYING PRIMARY AND SECONDARY FUELS

(71) Applicant: BMS-TEK, LLC, Melbourne, FL (US)

(72) Inventor: John Joseph MacDonald, Port Orange, FL (US)

(73) Assignee: BMS_TEK, LLC, Melbourne, FL (US)

( * ) Notice: Subject to any disclaimer, the term of this patent is extended or adjusted under 35 U.S.C. 154(b) by 0 days.

(21) Appl. No.: 14/690,719

(22) Filed: Apr. 20, 2015

(65) Prior Publication Data

US 2015/0226141 A1 Aug. 13, 2015

Related U.S. Application Data

(63) Continuation of application No. 14/436,986, filed as application No. PCT/US2014/010936 on Jan. 9, 2014.

(60) Provisional application No. 61/750,650, filed on Jan. 9, 2013.

(51) Int. Cl.

| | |
|---|---|
| ***F02D 41/00*** | (2006.01) |
| ***F02D 41/04*** | (2006.01) |
| ***F02D 41/24*** | (2006.01) |
| ***F02D 19/06*** | (2006.01) |

(Continued)

(52) U.S. Cl.

CPC ..... *F02D 19/0602* (2013.01); *F02D 19/0642* (2013.01); *F02D 41/0025* (2013.01); *F02D 41/0027* (2013.01); *F02D 41/04* (2013.01); *F02D 41/1446* (2013.01); *F02D 41/1461* (2013.01); *F02D 41/24* (2013.01); *F02M 25/12* (2013.01); *F02D 41/266* (2013.01); *F02D 2021/083* (2013.01)

(58) Field of Classification Search

CPC ..... F02D 19/00; F02D 19/02; F02D 19/021; F02D 19/022; F02D 19/023; F02D 19/024; F02D 19/026; F02D 19/027; F02D 19/061; F02D 19/0642; F02D 19/0644; F02D 19/0647; F02D 19/08; F02D 19/081; F02D 19/10; F02D 35/0015; F02D 35/0046

USPC ..... 123/27 GE

See application file for complete search history.

(56) References Cited

U.S. PATENT DOCUMENTS 4,166,437 A 9/1979 Bianchi
4,178,883 A 12/1979 Herth (Continued)

*Primary Examiner* — Stephen K Cronin
*Assistant Examiner* — Kevin R Steckbauer
(74) *Attorney, Agent, or Firm* — Ferdinand M. Romano; Beusse Wolter Sanks & Maire, PPLC.

(57) ABSTRACT

An engine system and method for operating an internal combustion engine in dynamically varying conditions. An exemplary system comprises an internal combustion engine configured to receive both a primary fuel and a secondary fuel into one or more chambers in which a combustion process occurs, a fuel injection system, an air intake manifold and a fuel manifold; an electronic system which controls timing and metering of the primary fuel and/or the secondary fuel in the combustion process; and a plurality of sensors positioned to measure one or more variables associated with combustion of the primary fuel in the presence of the secondary fuel. The electronic system is configured to apply a control signal to adjust an engine setting to reduce NOx emissions based in part on the magnitude of the variable.

25 Claims, 12 Drawing Sheets

(51) Int. Cl.

| | |
|---|---|
| ***F02M 25/12*** | (2006.01) |
| ***F02D 41/14*** | (2006.01) |
| *F02D 21/08* | (2006.01) |
| *F02D 41/26* | (2006.01) |

(56) References Cited

U.S. PATENT DOCUMENTS

| | | | | |
|---|---|---|---|---|
| 4,641,625 | A * | 2/1987 | Smith | F02D 19/0628 123/27 GE |
| 5,219,228 | A | 6/1993 | Ker | |
| 5,224,457 | A * | 7/1993 | Arsenault | F02B 43/00 123/27 GE |
| 5,394,330 | A | 2/1995 | Horner | |
| 5,450,829 | A * | 9/1995 | Beck | F02D 19/0631 123/435 |
| 6,155,212 | A | 12/2000 | McAlister | |
| 6,289,871 | B1 * | 9/2001 | Brown | F02D 19/0628 123/299 |
| 7,222,015 | B2 * | 5/2007 | Davis | F02D 19/027 701/103 |
| 2005/0029872 | A1 | 2/2005 | Ehrman | |
| 2009/0078236 | A1 | 3/2009 | Gallagher | |
| 2011/0166769 | A1 * | 7/2011 | Buechler | F02D 23/00 701/103 |
| 2013/0220274 | A1 * | 8/2013 | Deshpande | F02D 19/105 123/350 |
| 2013/0338901 | A1 * | 12/2013 | Kumar | F02D 19/0639 701/102 |
| 2013/0340717 | A1 * | 12/2013 | Avery | F02D 41/30 123/478 |

* cited by examiner

SYSTEM AND METHOD FOR IMPROVING PERFORMANCE OF COMBUSTION ENGINES EMPLOYING PRIMARY AND SECONDARY FUELS

RELATED APPLICATION

This national stage application claims priority to PCT Application PCT/US2014/10936 filed Jan. 9, 2014 which claims the benefit of provisional patent application U.S. 61/750,650 filed 9 Jan. 2013.

FIELD OF THE INVENTION

The present invention relates to internal combustion engines and, more specifically, to systems and methods which reduce exhaust emissions without degrading other engine performance parameters such as fuel efficiency.

BACKGROUND

Environmental compliance in the transportation industry continues to be problematic for society. Control of emissions levels is particularly costly for the commercial ground transportation industry because Compression Ignition (CI) engines have a set of technical challenges different from Spark Ignition (SI) engines. Present and future emissions compliance demand systems advancements in diesel engine technology. Solutions increase vehicle costs and elevate maintenance costs. Another undesirable outcome which stems from compliance with NOx emissions standards relates to the further generation of greenhouse gases, as reductions in fuel efficiency have been accepted as a necessary cost of compliance with NOx emissions standards.

Ideally, optimum fuel efficiency in a diesel or gasoline powered internal combustion engine requires adjustment to a relatively high air-to-fuel ratio such that the ratio is positioned away from a relatively rich fuel content to a slightly fuel rich ratio that is relatively close to the stoichiometric ratio. FIG. 1 is exemplary. With this higher combustion efficiency there is a relatively high combustion temperature which generates a greater mechanical force than achieved at lower combustion temperatures. This results in a relatively higher power output. It is also widely acknowledged in the literature that the higher combustion temperature results in higher NOx emissions levels. See FIGS. 1 and 2. Clearly, implementing environmentally acceptable solutions for controlling NOx emissions runs counter to the air-to-fuel configurations which result in more optimal fuel efficiencies and lower CO, HC and Soot emissions.

Despite this drawback, it is widely accepted that control of NOx emissions in diesel engines must be addressed with some form of an Exhaust Gas Recirculation (EGR) system which re-uses spent combustion gases. Typically, EGR systems recirculate gases from the exhaust manifold through the intake manifold. The extent of recirculation may range from 10 percent to over 50 percent. This affects reduction in the oxygen content at the intake manifold, effectively depressing the air-to-fuel ratio. With relatively rich fuel content in the combustion chamber, the reaction is shifted further away from the stoichiometric ratio. This, in turn, reduces the combustion temperature to a level which reduces NOx generation to a more acceptable level, perhaps up to about a fifty percent reduction. However, as the level of exhaust recirculation increases, there is increased heat rejection which requires a larger cooling system. Another drawback is that with exhaust gas recirculation diluting the volume percent of oxygen entering the engine from the intake manifold, the engine power density decreases. This gives rise to a need for a larger displacement engine to achieve the same power output. Also, when the volume percent of oxygen decreases, more soot is generated and more unburned hydrocarbons are also carried out the exhaust. With regulatory limits on both particulate matter and unburned hydrocarbons it has become necessary to incorporate additional equipment in the engine exhaust system, e.g., diesel particulate filters which may remove only about eighty five percent of the particulate matter. Generally, EGR systems require additional components to overcome or offset the aforementioned drawbacks. They result in excessive engine wear and higher maintenance requirements due, for example, to entry of carbon into the motor oil.

It is also recognized that an EGR system cannot, alone, provide sufficient NOx emission reductions to comply with many current and future emissions requirements. Due to the aforementioned drawbacks of EGR systems in diesel engines, original equipment manufacturers have incorporated systems with other means to reduce NOx emissions and to even reduce the percentage of exhaust gas recirculation. Selective Catalytic Reduction (SCR) systems are exemplary. Such systems inject an aqueous solution of urea into the exhaust flow in the presence of a catalyst to convert the NOx into molecular nitrogen and water. Treatment of exhaust gases by catalytic reduction after initial NOx removal with an EGR system enables engine operations to meet current regulatory requirements; and while it is essential to incorporate exhaust gas recirculation in diesel engines to meet emission level standards, the necessary level of recirculation can be reduced with an SCR system. Ideally, alternate means for reducing the NOx emissions should completely supplant the need for EGR systems.

The simplified schematic diagram of FIG. 3 illustrates a contemporary CI engine system 1 having a diesel fueled multicylinder engine 3 having an engine control system, an EGR emissions control system and a secondary exhaust emissions control system. The emissions control systems limit exhaust levels of NOx, particulate matter and hydrocarbons. Illustrated engine components include cylinders 11 in each of which a piston 13 is positioned for movement to compress an air-fuel mixture within a combustion chamber region 15. The engine includes an air intake manifold 19 which receives pressurized air from an intake 21 via a turbocharger 23. A positive displacement pump 31 sends pressurized fuel through the fuel rail 33 to an injector 35 for each cylinder. Exhaust from the combustion chambers exits the engine through the exhaust manifold 39, the turbocharger 23 and the exhaust pipe 43. The EGR emissions control system comprises an EGR manifold 45 connected between the exhaust manifold 39 and the air intake manifold 19 to mix a percentage of the exhaust with air received into the intake 21. An EGR valve 49 positioned in-line with the EGR manifold 45 regulates the amount of exhaust being returned to the combustion chambers via the intake manifold 19.

The secondary exhaust emissions control system includes electronic controller 51, a Diesel Particulate Filter 53 and a Selective Catalytic Reducer 55, each in line with the exhaust pipe 43. Upstream of the Filter 53 there are positioned in the exhaust pipe 43 an exhaust temperature sensor 57 and a NOx sensor 59 which each provide a signal 57*s* or 59*s* only to the controller 51. An intermediate temperature sensor 61 is positioned in the exhaust pipe between the filter 53 and the Selective Catalytic Reducer 55. An output NOx sensor 63 positioned in the exhaust pipe 5 measures the NOx level in exhaust leaving the pipe 43. The intermediate temperature sensor 61 and the NOx sensor 63 each provide a signal 61*s* or 63*s* only to the controller 51.

The engine control system comprises an Electronic Control Unit (ECU) 71 which is connected to receive signals from each of an intake manifold pressure sensor 75, an exhaust pressure sensor 77, a fuel rail pressure sensor 79, a barometric pressure sensor 81 and a crank shaft position sensor 83. The ECU also sends a control signal 87 to the EGR valve 49 to regulate the amount of exhaust flow recirculated into the manifold 19 and a control signal 89 to regulate the timing and duration of the opening of the fuel injector 35.

BRIEF DESCRIPTION OF THE FIGURES

The following drawings are provided to facilitate understanding of the inventive concepts described in the written description which follows, where.

Like reference numbers are used throughout the figures to denote like components. Numerous components are illustrated schematically, it being understood that various details, connections and components of an apparent nature are not shown in order to emphasize features of the invention. Various features shown in the figures are not shown to scale in order to emphasize features of the invention.

DETAILED DESCRIPTION OF THE INVENTION

Before describing in detail the particular methods and systems and components relating to embodiments of the invention, it is noted that the present invention resides primarily in a novel and non-obvious combination of components and process steps. So as not to obscure the disclosure with details that will be readily apparent to those skilled in the art, certain conventional components and steps have been omitted or presented with lesser detail, while the drawings and the specification describe in greater detail other elements and steps pertinent to understanding the invention. Further, the following embodiments do not define limits as to structure or method according to the invention, but provide examples which include features that are permissive rather than mandatory and illustrative rather than exhaustive.

Figure 1:
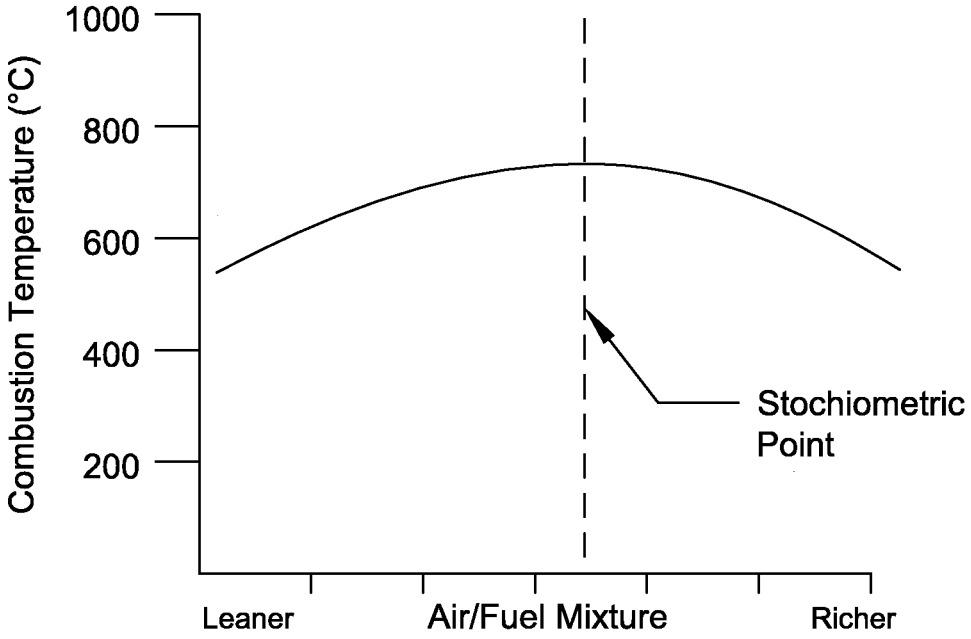
Figure 1 Prior Art
FIG. 1 illustrates a general relationship between the air-to-fuel ratio and combustion temperature for an internal combustion engine.
Figure 2:
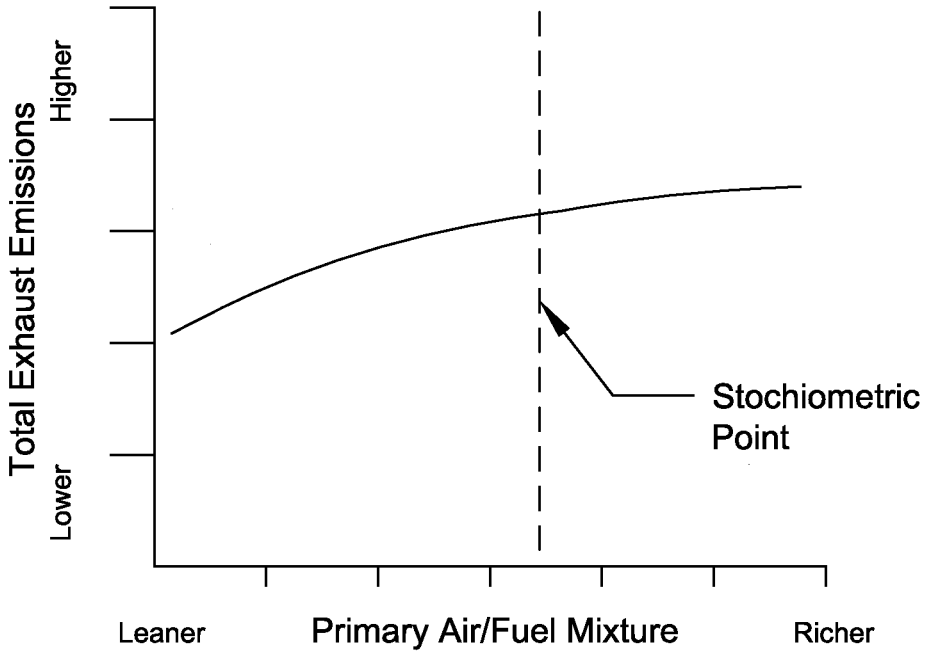
Figure 2 Prior Art
FIG. 2 illustrates a relationship between the air-to-fuel ratio and NOx emissions for an internal combustion engine which, in conjunction with FIG. 1, indicates a relationship between combustion temperature and NOx emissions.
Figure 3:
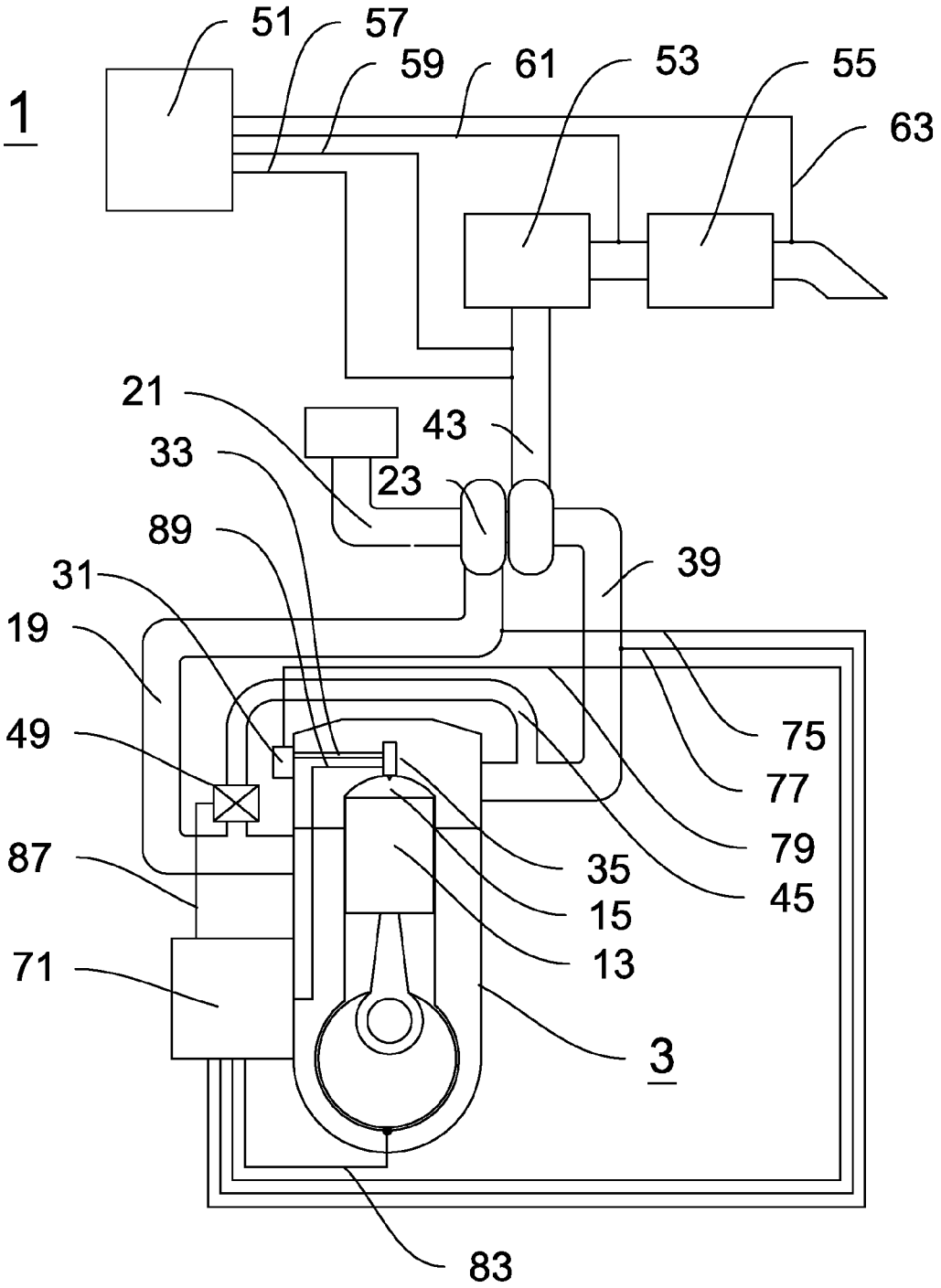
Figure 3 Prior Art
FIG. 3 is a simplified schematic diagram of a prior art CI engine system.

With reference to FIG. 4, there is shown a CI engine system 100 according to an embodiment of the invention. Although not illustrated in all of the figures, the system 100 may include the secondary exhaust emissions control system (e.g., an electronic controller 51, a Diesel Particulate Filter 53 and a Selective Catalytic Reducer 55). The system 100 also includes many of the other features of the engine system 1 as shown in FIG. 3. Like features in these and other illustrated embodiments are identified with like reference numbers. In addition, the system 100 includes a NOx control system which comprises a control module 104, a hydrogen generation system 106, an exhaust gas temperature sensor 108, and a NOx sensor 112.

Hydrogen generation systems suitable for practicing the invention are designed to produce hydrogen-containing gaseous products suitable for injection into an engine combustion chamber because they contain reactive hydrogen. The term hydrogen containing gaseous products as used herein and in the claims means products which contain reactive hydrogen, i.e., containing atomic hydrogen (H) or molecular hydrogen ($H_2$) or hydrogen in the form $H^+$, $OH^-$, $O^-+H^+$, or $H_2O_2$ suitable for use in an internal combustion engine to facilitate enhanced performance when also burning another fuel. The hydrogen containing gaseous products may contain other components such as $H_2O$. When the gaseous product is generated by electrolysis the product includes oxygen where the ratio of hydrogen to oxygen is 2:1 and the material is referred to as oxyhydrogen or HHO. Although disclosed embodiments of the invention include hydrogen generation systems which produce a reactive hydrogen species, the hydrogen-containing gaseous products include pre-prepared secondary fuel containing reactive hydrogen. Also, a hydrogen generation system may produce reactive hydrogen in situ in the presence of heat and a catalytic material such as copper. For example, a light hydrocarbon such as methane may be passed through a variable number of heated copper tubes to provide a supply of reactive hydrogen. The process may involve generation of a plasma or thermal cracking or a uv photoelectric process.

A function of the control module 104 is to modify the behavior of one or more original equipment control circuits of a vehicle by adjusting the signals normally sent directly from sensors into the ECU 71. By way of example, in the embodiment of FIG. 4, the control module 104 modifies magnitudes of one or more sensor signals, e.g., for intake manifold (boost) pressure, fuel rail pressure, barometric pressure, exhaust pressure and or temperature of air at the inlet to the intake manifold.

Embodiments of the invention are in recognition that, because an ECU modifies certain engine variables in response to changes in sensor data (e.g., pulse widths of fuel injection timing signals), the same input terminals of an ECU utilizing this sensor data can be used to further change engine parameters, e.g., in a cumulative manner, based on information provided to the terminal in addition to or in place of the data received directly from the sensor. Thus received sensor signal data can be modified based on additional information in order to further alter those engine variables of interest in response to changing conditions such as a change in the air-to-fuel ratio resulting from a change in the rate of flow of a secondary fuel into the intake manifold of the engine.

With reference to FIG. 4, when a signal generated by such a sensor is received as a voltage magnitude, the signal is routed into the control module 104 prior to input to the ECU 71 for conversion to a digital signal, and a digital adjustment is made to provide a different signal magnitude. The adjusted signal magnitude then undergoes a digital-to-analog conversion to provide a modified analog signal representative of the adjusted magnitude for input to the ECU. Generally, the sensor of the modified control loop may be any sensor useful for adjusting an engine parameter. With the magnitude output by a sensor being representative of fuel rail pressure, the ECU 71 might normally adjust the volumetric flow of the primary fuel into the combustion engine chambers based solely on a change in fuel rail pressure. Instead, an adjusted version of the magnitude sensor output is provided as the pressure sensor input to the ECU. This causes a shift in the programmed volumetric flow rate of the primary fuel relative to the flow rate which would otherwise result based on a direct and unaltered measurement of the fuel rail pressure.

To effect this modification of any sensor signal input to the ECU 71, the control module 104 may be microprocessor based and programmed in accord with an algorithm or may access values from a look-up table. More simply, the control module may apply one or more predefined offset values to adjust the sensor magnitude as a digital signal or as an analog signal. In the illustrated embodiments this control module functionality is implemented with a microprocessor. It is to be understood that in embodiments which integrate functions of the control module 104 with the OEM ECU, separate analog-to-digital and digital-to-analog conversions may not be necessary.

In embodiments of the invention, the control module may include an algorithm, a look-up table or, more simply, one or more predefined offset values, which are applied to adjust the volumetric flow of the primary fuel to improve engine performance while a secondary fuel is sent into the combustion chamber regions. The magnitude of voltage adjustment made by the control module 104 may simply be a fixed value based on analysis of engine performance under differing rates of primary fuel delivery (e.g., diesel fuel delivery) and manifold pressure while both the primary and the secondary fuel are applied. Other embodiments include variable voltage shifts for the sensor value to more optimally adjust the rate of fuel delivery, e.g., based on varying engine dynamics or changes in ambient conditions. The secondary fuel may be held at a fixed flow rate while the analysis is performed by varying primary fuel input rates or an algorithm may provide adjustment based in part on varied flow rate of the secondary fuel.

Figure 8:
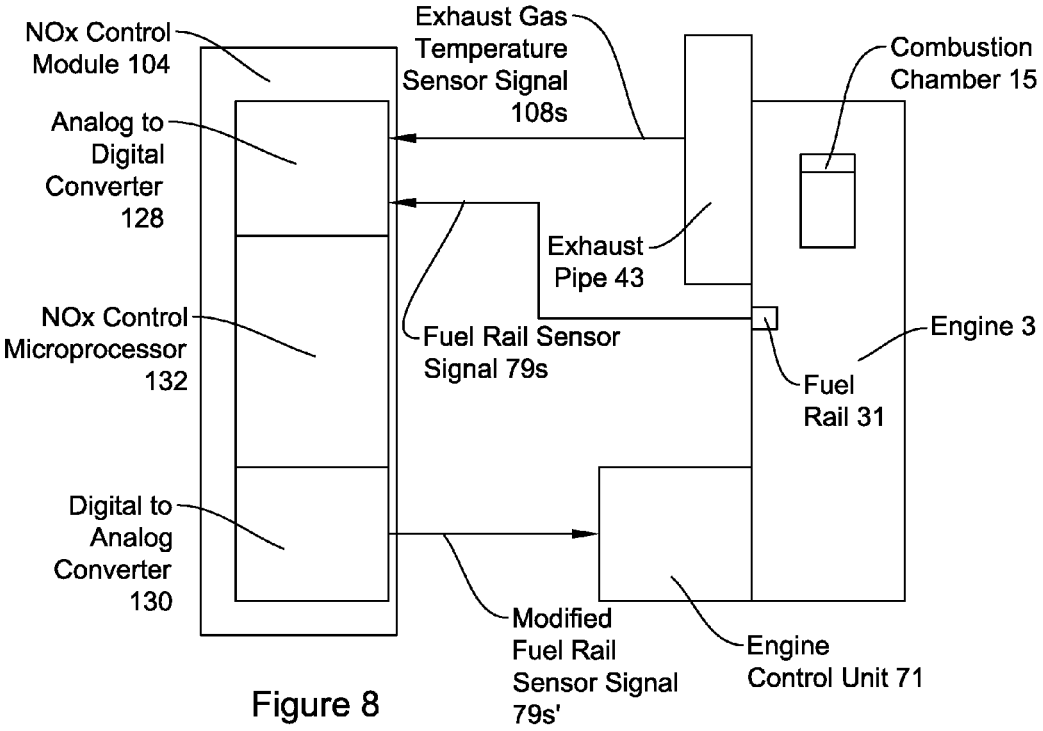

Before describing specific features of the CI engine system 100 shown in FIGS. 4, brief descriptions are provided with reference to simplified control circuit FIGS. 7 to 10. These illustrate numerous ways that control circuit concepts are extendable to effect adjustment of dependent variables, such as the NOx emission level. With reference to FIG. 8, a voltage signal generated by a fuel rail pressure sensor is first routed through the NOx control module prior to input to the ECU. This voltage signal is modified based on an exhaust sensor output value prior to input to the OEM ECU. Exemplary sensors for this type of feedback control application may measure other dependent variables such as exhaust gas temperature or concentration of $O_2$, $NO_x$ or $SO_x$ in the engine exhaust. The sensor output may be routed through the control module and compared to a predetermined value to optimize or minimize the sensor value, e.g., to minimize a NOx emission level. Based on the difference between the received sensor voltage output and the predetermined value, an algorithm determines an adjustment to the voltage signal generated by the fuel rail pressure sensor. The adjustment modifies the rate of primary fuel delivery to reduce the difference between a sensor voltage output and a predetermined value. The control circuitry continues to modify the rate of primary fuel delivery until the difference between the predetermined value and the measured value of the dependent variable approaches zero.

Figure 9:
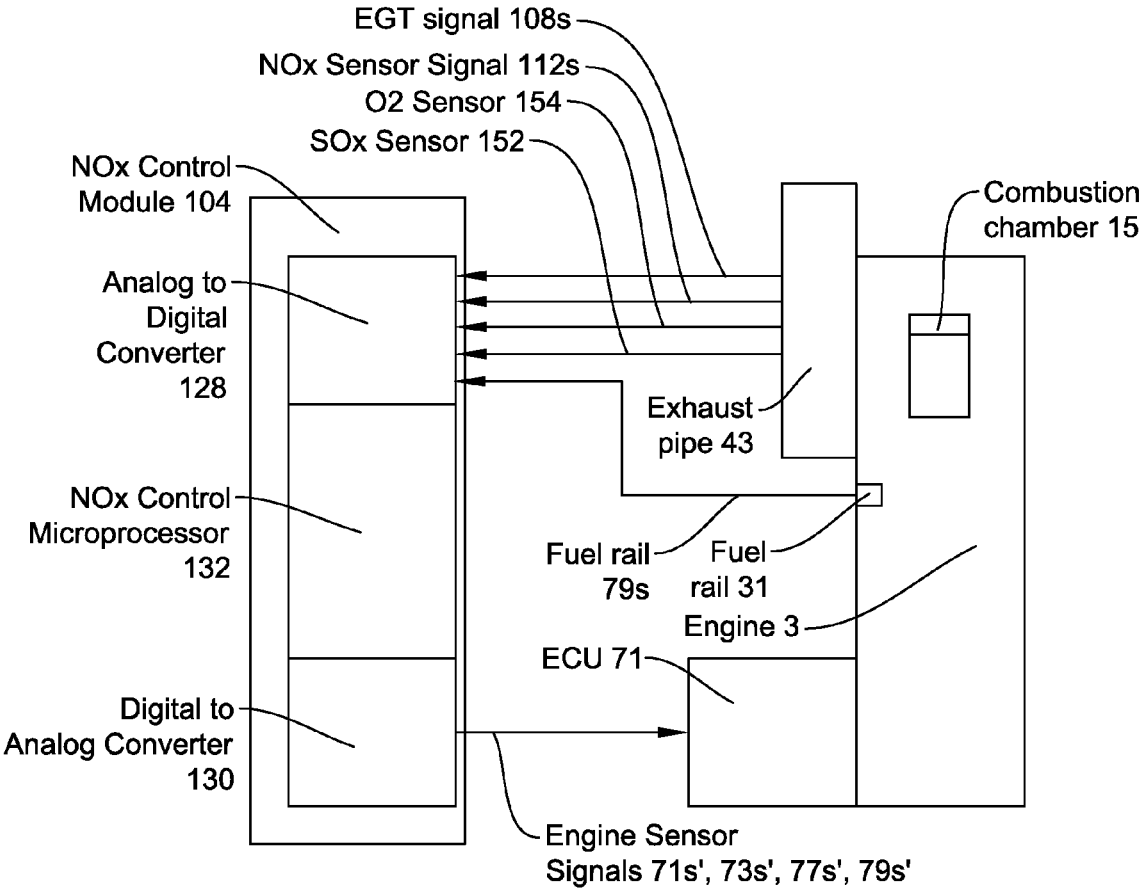

The control circuitry of FIG. 9 modifies the rate of delivery of secondary fuel to adjust one or more dependent variables. Exemplary inputs to the loop are analog signal received from any one or more of an exhaust gas temperature sensor, an oxygen sensor, a NOx sensor a SOx sensor. The sensor voltage output is routed through the control module 104, digitized and compared to a predetermined value. Based on the difference between the sensor voltage output and the predetermined value, an algorithm or a matrix of values is used to determine an adjustment to the rate of delivery of the secondary fuel. In another embodiment, when the secondary fuel source is generated at the engine, e.g., via an oxyhydrogen generator, the comparison between measured temperature and a reference temperature value can be used to determine whether to turn the secondary fuel delivery on or off or to vary the rate of oxyhydrogen production by altering the power or by powering down the generator.

Figure 10:
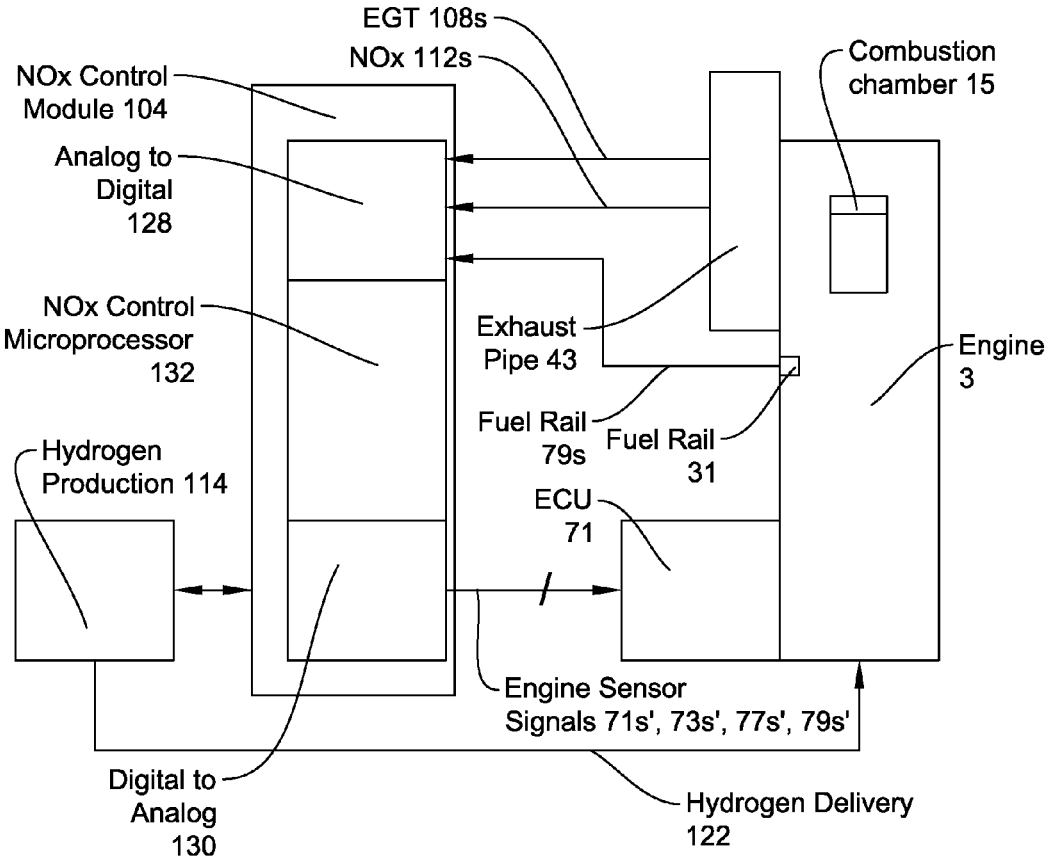

As illustrated in FIG. 10, a combination of afore described control circuits or loops may be formed in the system to operate sequentially or simultaneously to modify one or more engine parameters based on sensor data inputs to the control module 104. In this embodiment, both the volumetric flow of the primary fuel and the volumetric flow of the secondary fuel are adjusted, e.g., to adjust one or several variables. The input to each control circuit may be an analog signal received from a sensor. Each sensor voltage output is routed through the control module 104 where it is compared to a predetermined value. Based on the difference between each sensor voltage output and an associated predetermined value assigned for the sensor, an algorithm or a matrix of values is used to determine a command signal sent to control delivery of, for example, the secondary fuel or to adjust a voltage signal generated by a sensor, e.g., the fuel manifold pressure sensor or a NOx sensor. Each adjustment is made to a sensor voltage signal prior to input of the signal to the ECU 71. Signals received from each analog sensor are converted to digital signals, adjusted in magnitude based on a determination made by an algorithm and converted to an analog signal. Each adjustment modifies an engine control parameter, e.g., the rate of primary fuel delivery, and may reduce the difference between an output voltage from one of the sensors and and an associated predetermined value. The control loops may continually modify the rate of primary fuel delivery until the difference between the predetermined value and the value of the measured dependent variable approaches zero.

Referring again to FIG. 4, the NOx control module 104 contains a serial bus 124 through which data is transferred between thermocouple circuitry 126, analog-to-digital converter (ADC) circuitry 128, digital-to-analog circuitry 130, and processing circuitry which includes a microprocessor 132 and memory 134. The processing circuitry is also interfaced with one or more communications modules 138 which may include GSM or CDMA or WiFi capability or a GPS receiver. The module 104 receives: a temperature signal 57*s* on line 57*l* from the exhaust gas sensor 57 which is input to the thermocouple circuitry 126; and the following signals which are input to the analog-to-digital converter circuitry 128: an air pressure signal 75*s* from the intake manifold pressure sensor 75, an exhaust pressure signal 77*s* from the exhaust pressure sensor 77, a fuel rail pressure signal 79*s* on line 79*l*, from the sensor 79, and a barometric pressure signal 81*s* from the sensor 81 on line 81*l*.

Digitized sensor signals output from the thermocouple circuitry 126 and the analog-to-digital converter circuitry 128 are transmitted on the serial bus 124 to the microprocessor 132 which determines changes in HHO production levels (e.g., based on weighted sensor data). The microprocessor 132 also modifies the magnitudes of several sensor signals: the pressure signal 75*s* from the intake manifold pressure sensor 75, the pressure signal 77*s* from the exhaust pressure sensor 77, the fuel rail pressure signal 79*s* from the sensor 79, and the barometric pressure signal 81*s* from the sensor 81. The revised signal magnitudes are sent to the digital-to-analog circuitry 130 over the bus 124 and are then output to the ECU 71 to perform functions, including modification of the air-to-primary (diesel) fuel ratio and control of dependent variables such as NOx emissions.

In one embodiment the control of variables is had through the process of continually monitoring data acquired with sensors while adjusting independent variables. In one application the rate of primary fuel delivery, an independent variable, is adjusted while comparing values of a dependent variable to effectively modify the rate of primary fuel delivery until the difference between the predetermined value and the measured value of the dependent variable approaches zero or a minimum. Similarly, the rate of delivery of secondary fuel, also an independent variable, is adjusted while comparing values of a dependent variable (e.g., the level of NOx emissions) to effectively adjust the magnitude of the dependent variable. To this end, the sensor output may be routed through the control module 104, digitized and compared to a predetermined value. Based on the difference between the sensor voltage output and the predetermined value, an algorithm or a matrix of values is used to determine an adjustment to the independent variable. Thus under conditions where the engine power is increased increasing the flow rate of a primary fuel into the engine, control circuitry may adjust the rate of delivery of the secondary fuel as the rate of primary fuel delivery changes.

Figure 4A:
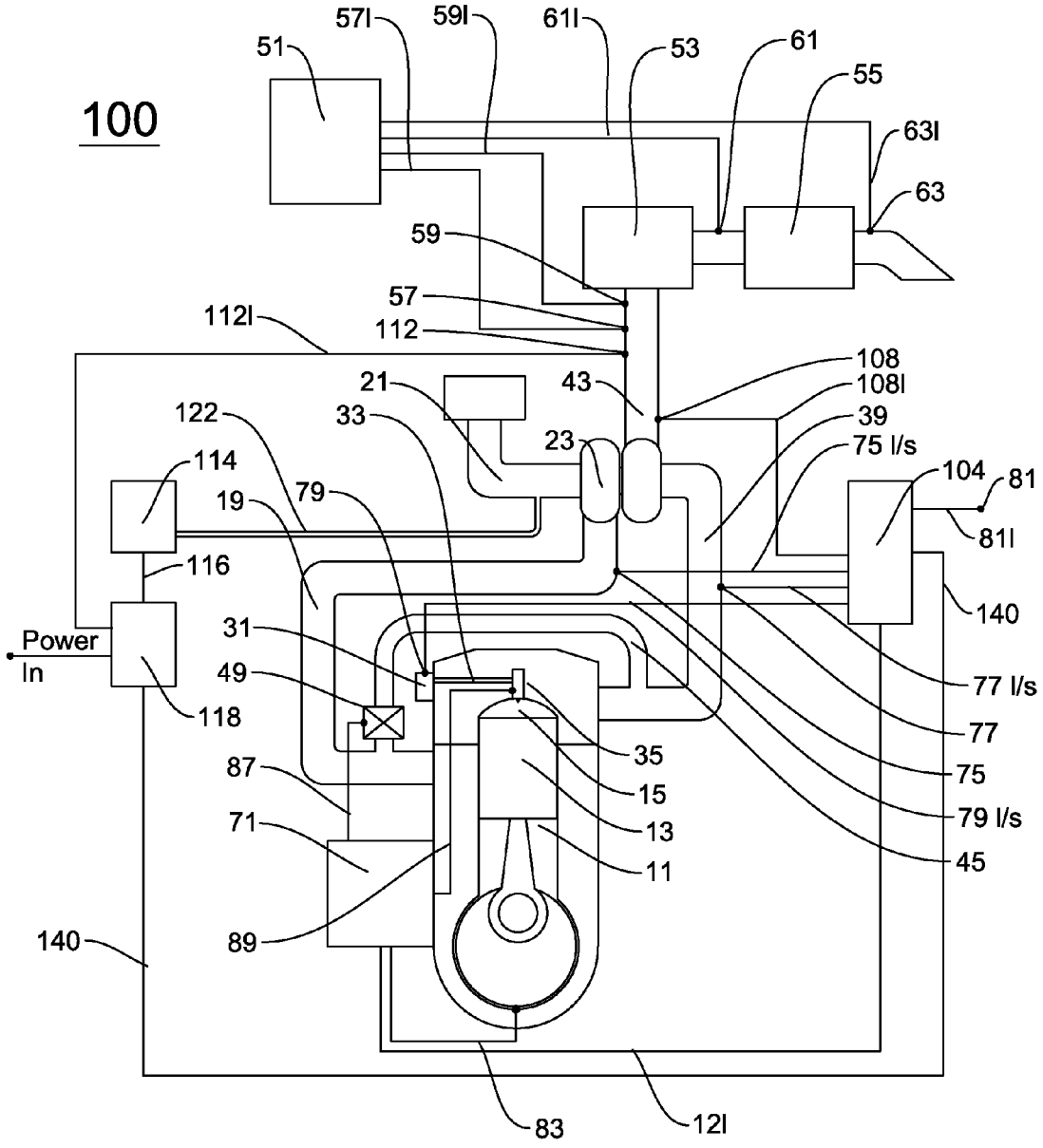
FIG. 4A is a schematic illustration of a CI engine system according to an embodiment of the invention which incorporates a NOx control system comprising a control module and a hydrogen generation system.
Figure 11:
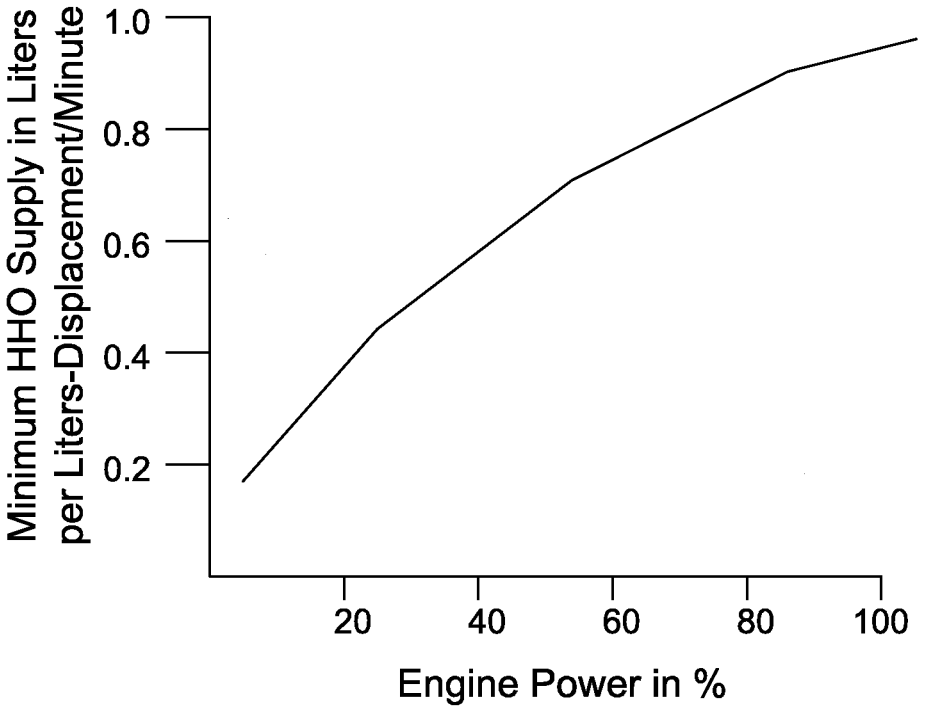
FIG. 11 illustrates a general relationship of a minimum HHO injection to achieve NOx reduction as a function of engine power.

The hydrogen generation system includes a hydrogen generator 114 and hydrogen control electronics 118 shown in FIG. 4A. The NOx control module 104 continually determines an optimal HHO production level to minimize the output of NOx. This level may be based on feedback control or based on a predetermined relationship developed through acquisition of characterization data. The hydrogen control electronics 118 receives a signal indicative of this level via an optically isolated RS232 serial link 140. See FIG. 4C. Generally the HHO production level increases as a function of engine output. It has been determined that to effect NOx reduction at high engine output levels the engine should receive a minimum of one liter of HHO per minute per liter of engine displacement. The general relationship is between minimum HHO injection and engine power is shown in FIG. 11.

The hydrogen control electronics 118 includes a CPU 142 which controls HHO production and safety control, and MOSFETs 144 that regulate the rate of hydrogen production, including regulation of electrolytic cells that produce the HHO, and regulation of the electrolyte pump, electrolyte heaters and cooling fans. The electronics monitors temperature to provide data for cooling and to assure safe limits of operation. The CPU also controls circuitry 148 which includes safety interlock switches and electrolyte level monitors. Signals 112*s* from the NOx sensor 112 are received via a CANBUS into the CPU 142 and transferred to the microprocessor 132 in the NOx control module 104 via the RS232 serial link 140. The microprocessor 132 monitors the NOx signal as part of the control function which minimizes emissions as a function of shifts in magnitudes of the independent variable signals to 75*s*', 77*s*', 79*s*' and 81*s*' which are sent to the ECU 71 in lieu of signals 75*s*, 77*s*, 79*s* and 81*s*.

Figure 4B:
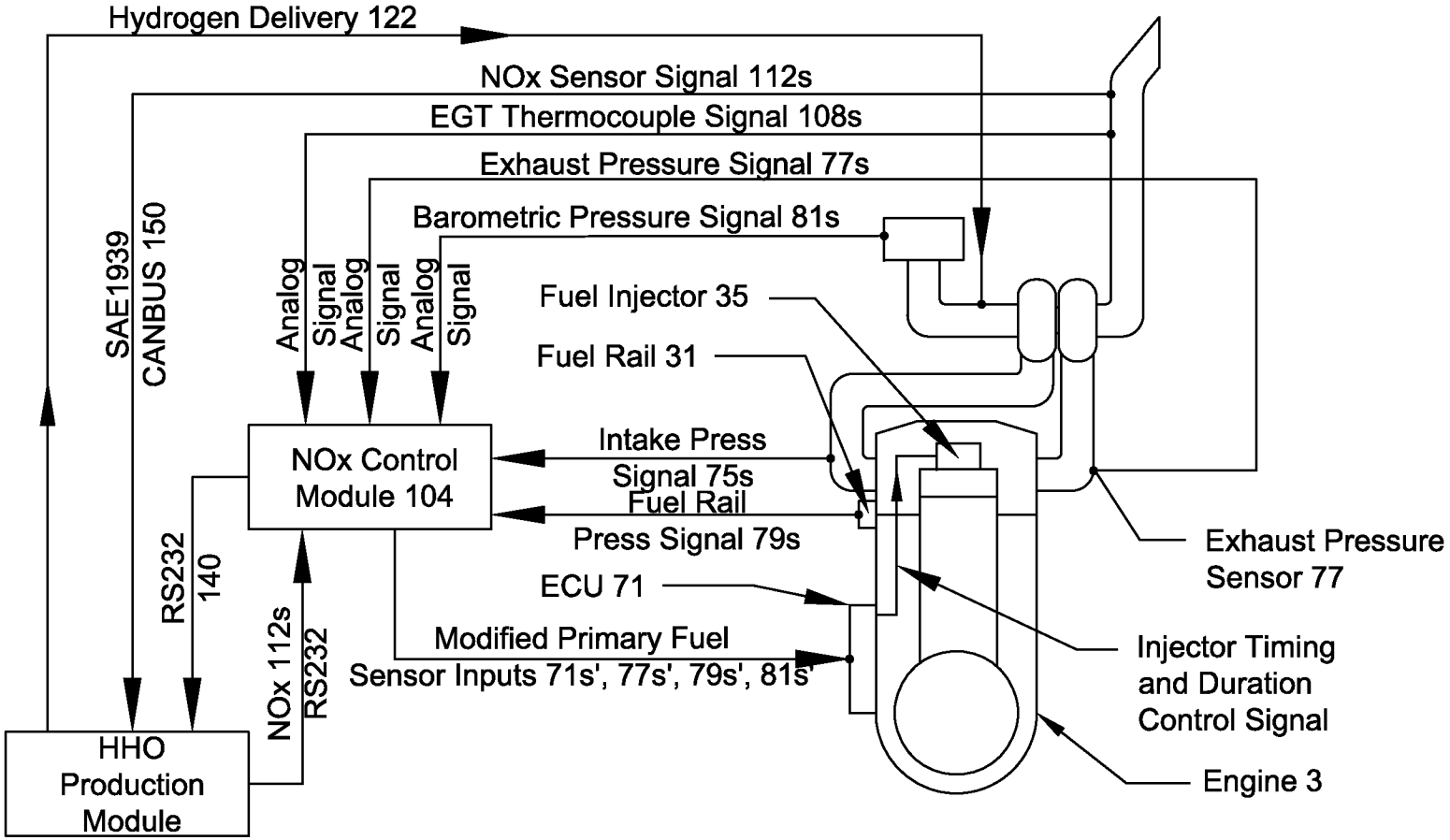
FIG. 4B illustrates control circuitry of the CI engine system of FIG. 4A.
Figure 4C:
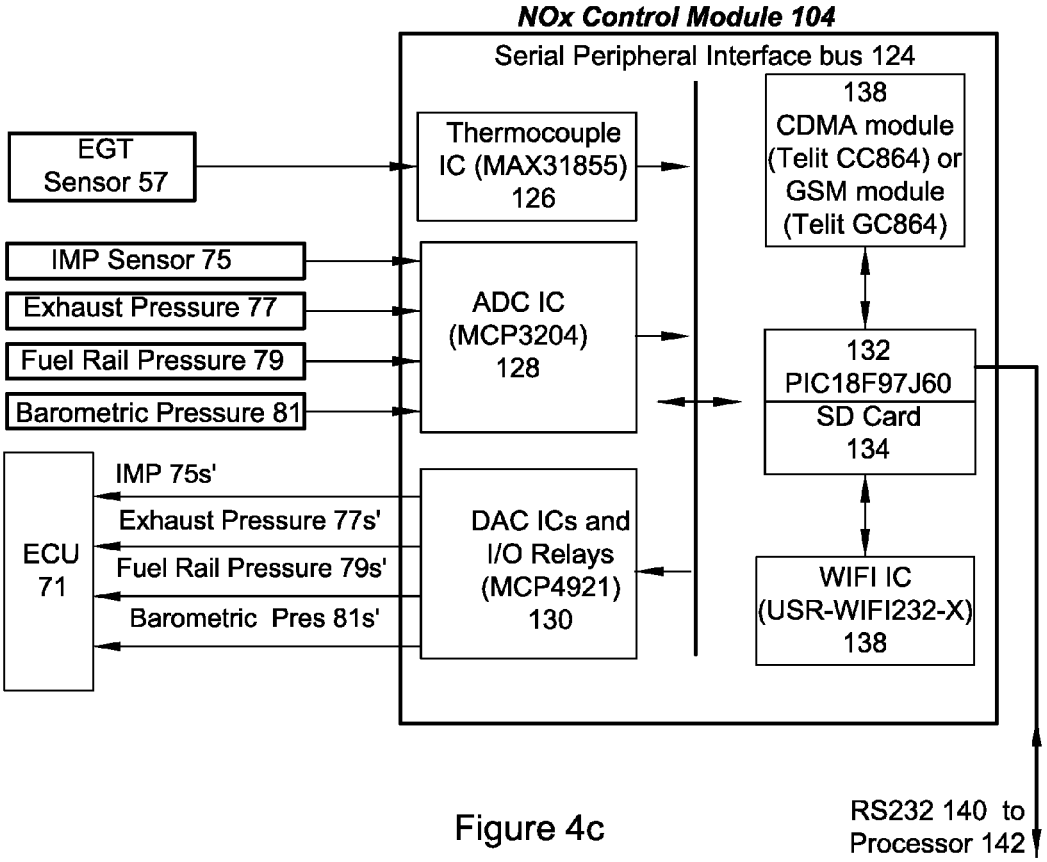
FIG. 4C illustrates the control module of FIG. 4A.
Figure 4D:
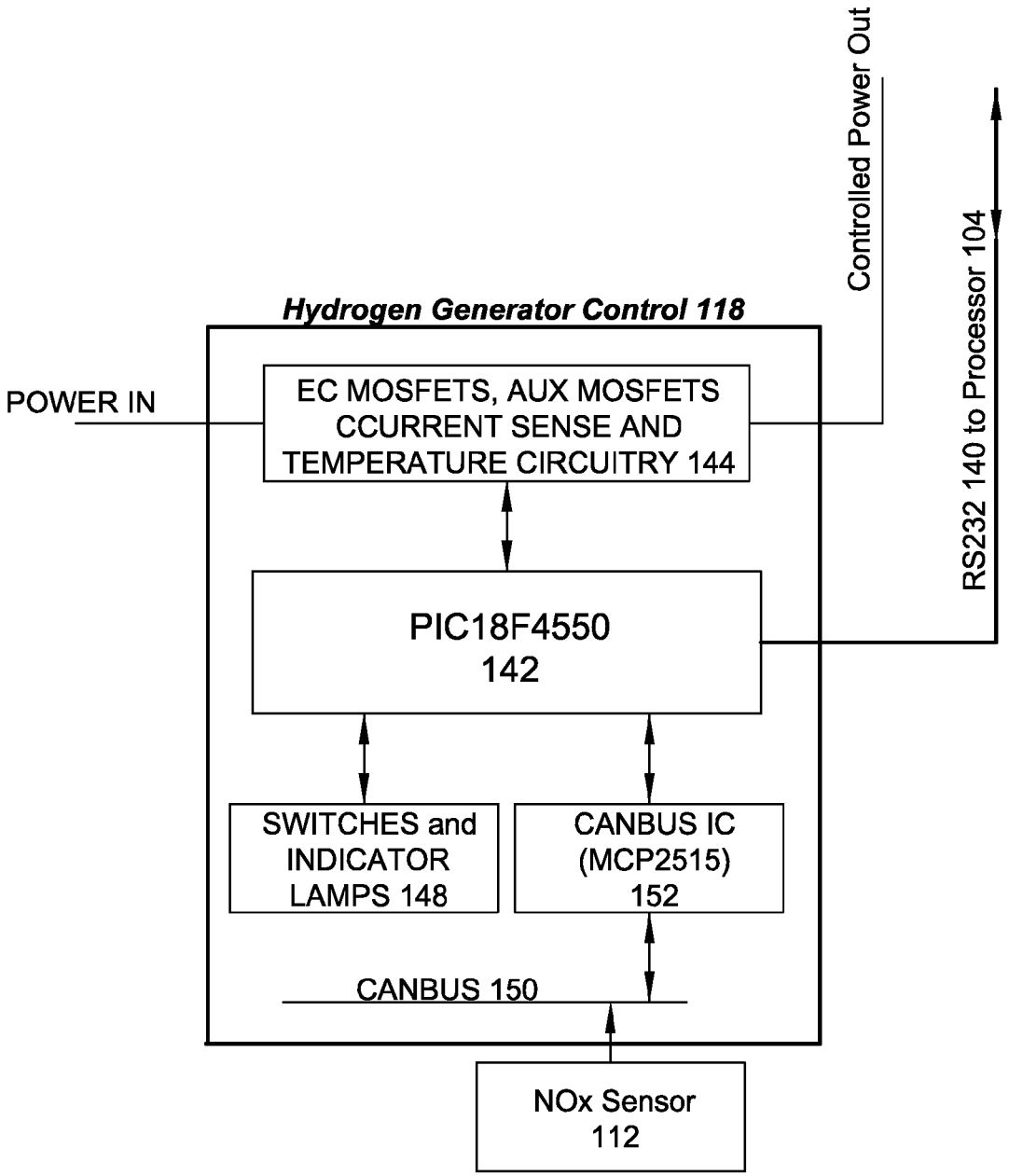
FIG. 4D illustrates hydrogen control electronics of the hydrogen generation system shown in FIG. 4A.

With further reference to FIG. 4B, operation of the NOx control system begins on engine start-up with the NOx control module 104 determining that the intake manifold pressure 71 is above ambient pressure. After thirty seconds the control module 104 sends a signal to the hydrogen generation control electronics 118 via the optically isolated RS232 line 140. In response to the signal the control electronics 118 sends a predetermined level of power to the hydrogen generator 114 to start production at minimum level. This initiates control loop activity with the NOx control module 104 receiving and processing values from the sensors, e.g., the OEM barometric pressure sensor 73, the intake manifold pressure sensor 75, the exhaust manifold pressure 77, the fuel rail pressure sensor 79 and the barometric pressure sensor 81. The NOx control module 104 shifts the magnitudes of the sensor signals 73*s*, 75*s*, 77*s*, 79*s*, 81*s* to adjusted magnitudes 73*s*, 75*s*, 77*s*, 79*s*, 81*s*' and passes those shifted values via the lines 73*l*, 75*l*, 77*l* 79*l* and 81*l* to the ECU 71 in lieu of the values 73*s*, 75*s*, 77*s*, 79*s*, 81*s* causing an adjustment in the air-to-fuel ratio. The NOx control module 104 also reads the values of the exhaust gas temperature signal 108*s* and the NOx sensor signal 112. The microprocessor 132 receives digital values of these sensor magnitudes and values and calculates a new value, based on the signal data received from the sensors 108 and 112, for an appropriate HHO production level to reduce the output of NOx. That updated level is sent to the hydrogen generation control electronics 118 via the RS232 line 40, causing a power change in operation of the hydrogen generator 114 to adjust the production of the HHO. The NOx control module 104 then cycles back to read sensor signals 73*s*, 75*s*, 77*s*, 79*s*, 81*s* and continues operation.

Figure 5:
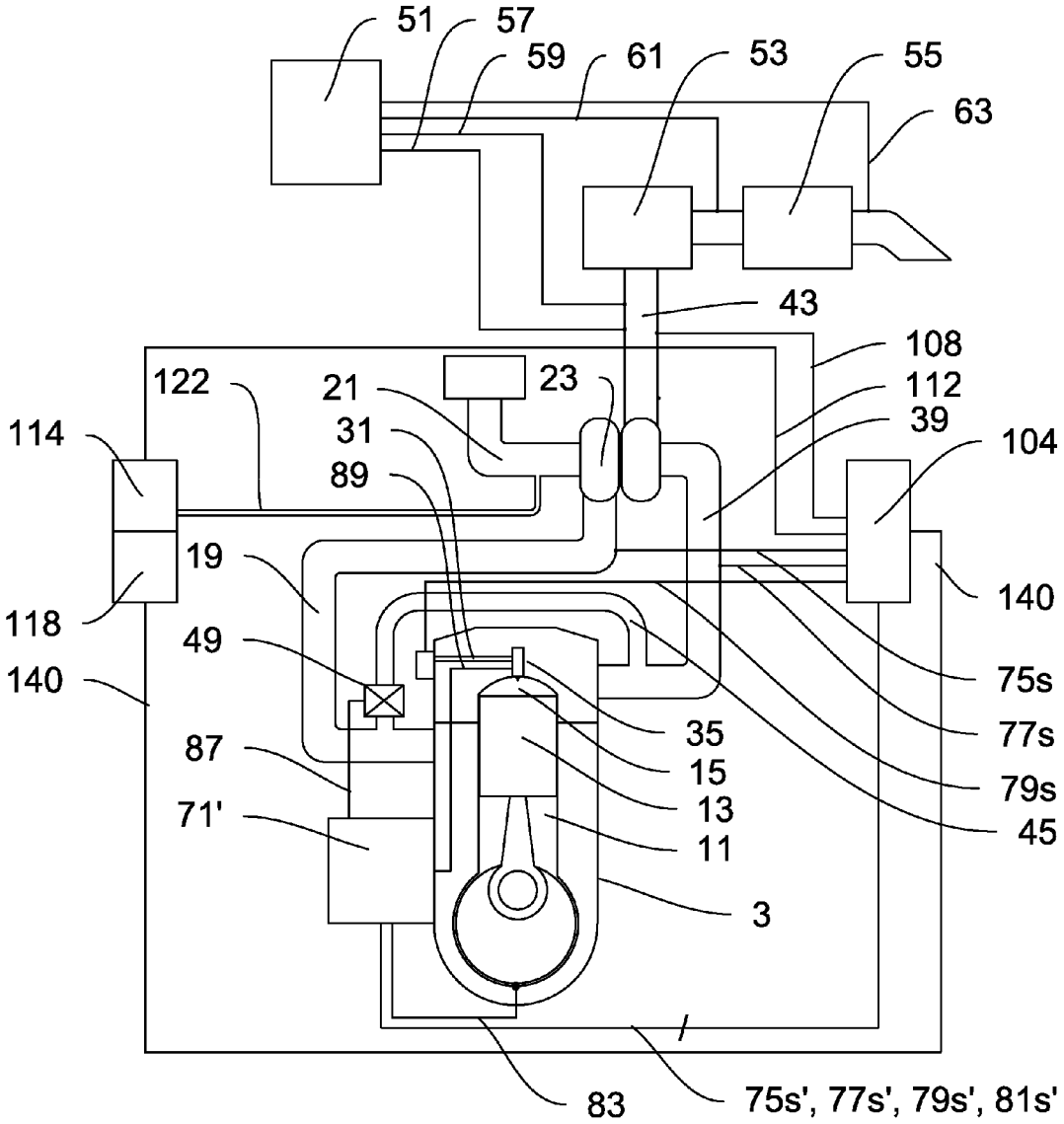
FIG. 5 illustrates another embodiment of the CI engine system according to the invention.

FIG. 5 illustrates the CI engine system 100 according to another embodiment of the invention. This embodiment of system 100 includes many of the features of the engine system 1 shown in FIG. 4 and like features are identified with like reference numbers. However, the embodiment of FIG. 4 integrates the functionality of the NOx control module 104 into the ECU, which is designated as ECU 71. Integration of this functionality provides multiple advantages. For example, less hardware is required to modify the pulse widths of the fuel injection signals. Further, the adjustments to the fuel system can be made directly to the injector circuitry, whereas in the embodiment of FIG. 4 the adjustments are made by changing an independent variable, i.e., to provide a pseudo value, which causes the ECU to change the timing or width of the pulses. It is also contemplated that, with integration of these functionalities, numerous modifications of the control circuitry may be had to effect a more efficient or responsive NOx control system.

Figure 6:
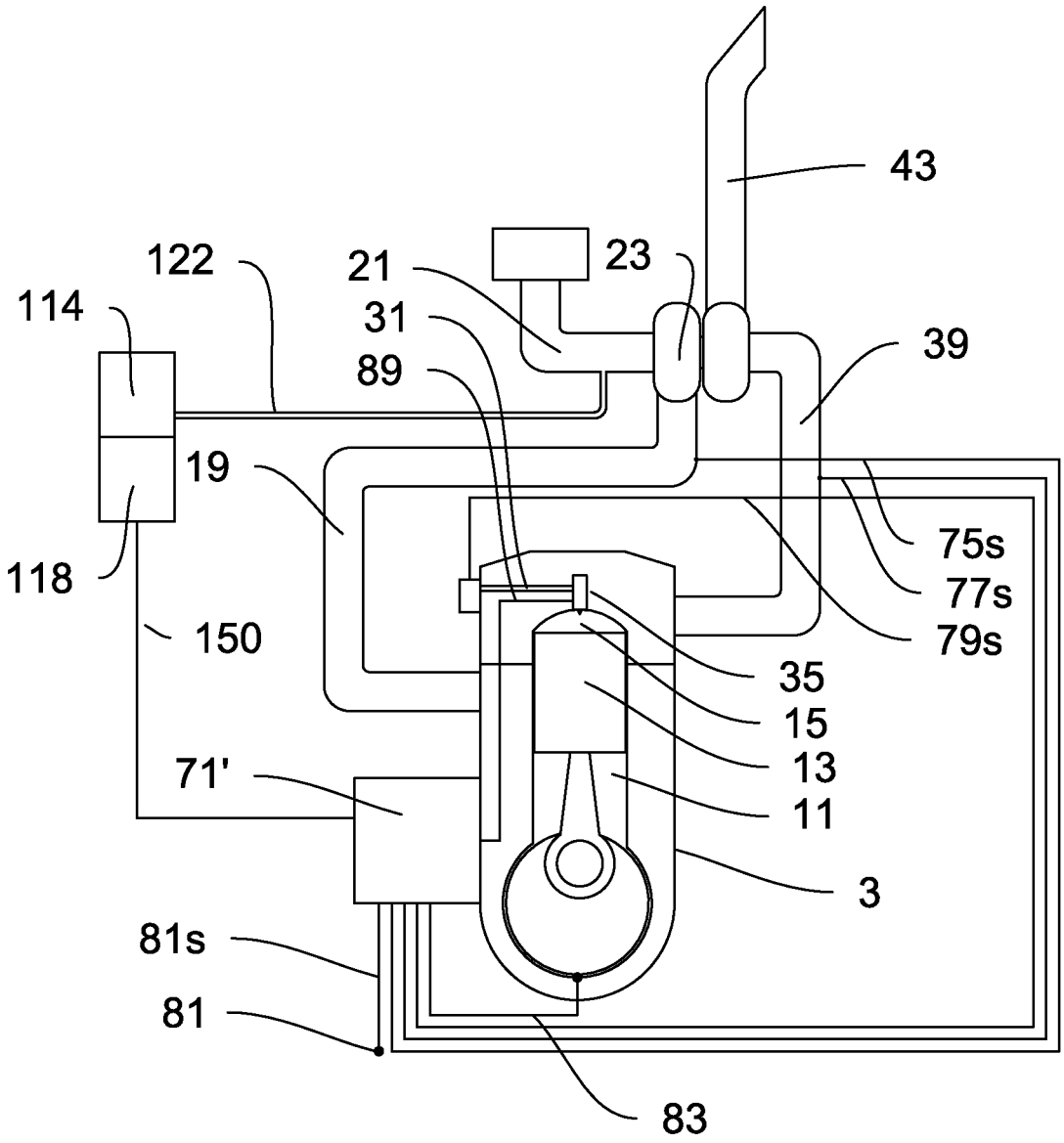
FIG. 6 illustrates still another embodiment of the CI engine system according to the invention.
Figure 7:
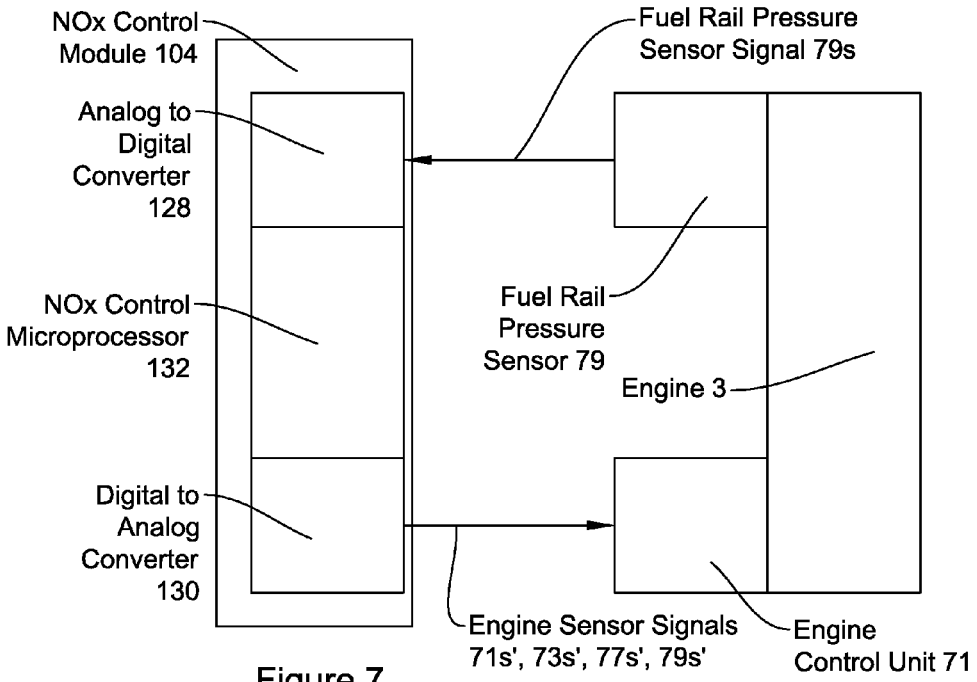
FIGS. 7-10 are schematic illustrations of CI engine systems according to embodiments of the invention to illustrate numerous ways that control circuit concepts are extendable to effect adjustment of dependent variables, including NOx emission levels.

FIG. 6 illustrates the CI engine system 100 according to still another embodiment of the invention which includes many of the features of the engine system 1 shown in FIGS. 4 and 5, with like features are identified with like reference numbers. Given a sufficient volume of reactive hydrogen production (e.g., greater than one liter of HHO per minute per liter of engine displacement) the mitigation of NOx emissions by the NOx control system can be so effective as to remove any need for both the EGR emissions control system and the secondary exhaust emissions control system. Advantageously, this eliminates high maintenance costs and wear on the engine 3.

While it has been a desire in the art to deploy systems which utilize secondary fuels, there has been no recognition that secondary fuels can be applied to CI and SI engines to reduce NOx emissions. The present invention provides system configurations incorporating secondary fuels and associated methods which can result in high fuel efficiency and NOx pollution reduction, each accompanied by high reliability under engine loading, whereas prior system designs which use secondary fuels for fuel efficiency have not shown consistent performance under the typical ranges of engine operating conditions. With the afore described methods, the benefits of premixing a gaseous second fuel source with air for injection into cylinders of an internal combustion engine can provide NOx reduction with the addition of control systems that are designed to continually monitor and adjust the engine parameters. A feature of illustrated embodiments is adjustment of parameters during or after changes in engine operating conditions. With respect to vehicles operating with a secondary fuel source, it is possible to both optimize fuel efficiency and reduce NOx emissions under both dynamic and steady state modes, e.g., for vehicle operation under acceleration or under constant speed conditions.

Field data can be used to identify key variables and develop input adjustment signals, e.g., based on measured concentration levels, to control NOx concentrations. The control may be effected with an algorithm that generates control signals used to modify engine parameters including parameters conventionally used to adjust engine performance or emission levels.

It is well known that engines operate at an air-to-fuel ratio that is typically lower than the ideal or stoichiometric ratio. A feature of the invention is adjustment of the air-to-fuel ratio for a primary fuel (e.g., gasoline or diesel fuel) in a dual fuel combustion process. The terms "dual fuel process" and "secondary fuel" as used herein refer to supplying an engine with a first, main fuel, e.g., a liquid fuel such as diesel fuel or gasoline, and a second fuel, typically in a lesser quantity, such as a gaseous mixture having a substantial content by volume of reactive hydrogen or another reactive species. With other relevant parameters remaining unchanged, a reduced fuel volume results in an increased air-to-fuel ratio. With a gaseous secondary fuel present in the cylinders adverse effects of reducing the fuel-to-air ratio are less severe than when running the engine without the secondary fuel. Consequently there is an expanded range of acceptable air-to-fuel ratio from which an optimum ratio can be selected to improve fuel economy and or lower NOx emissions. A feedback control loop may be provided to use a parameter in an algorithm which generates an adjustment value to mitigate NOx emissions. The control loop may also be used to adjust the measured parameter by modifying an input variable, e.g., the air-to-fuel ratio. Weighting functions may be assigned to determine relative influence of multiple control loops. The weighting functions may vary temporally or based on engine operating conditions, including ambient states.

During extensive over-the-road testing optimum points at which to shift the magnitudes of the sensor output signals were identified to take full advantage of the addition of the HHO over the full range of operating conditions. To that end the present invention applies a control that continuously reads multiple engine sensors (e.g., fuel manifold pressure, intake manifold pressure, exhaust manifold pressure, exhaust gas temperature, ambient barometric pressure, etc.) and dynamically adjusts those sensor readings to achieve optimum levels of emissions reduction and enhanced fuel economy. The modified levels may then be further adjusted in response to two additional sensors signal outputs: a NOx sensor and an Exhaust Gas Temperature sensor, before the sensor signals are passed on to the ECU. This results in the decreased output of NOx, HC and PE thus reducing the load on EGR systems and exhaust after-treatment systems.

Features of the invention have been illustrated for engines having OEM electronic control systems, but the disclosed concepts may be extended to engines not having such systems. In one series of embodiments, such engines may be equipped with custom versions of an electronic control module to provide one or more of the functionalities which have been disclosed. As another example, for an engine having a mechanical fuel injection system, an analog or digital control may be incorporated to adjust the amount of primary fuel delivered to the engine by electrically or mechanically adjusting the fuel manifold pressure. The pressure adjustment may be had by providing an adjustable relief valve or a selectable secondary relief valve with a lower set pressure than that of the primary relief valve.

While the invention has been described with reference to particular embodiments, it will be understood by those skilled in the art that various changes may be made and equivalents may be substituted for elements thereof without departing from the scope of the invention. Accordingly, the scope of the invention is only limited by the claims which follow.

The claimed invention is:

1. A method for limiting output of $NO_x$ when operating an internal combustion engine in dynamically varying conditions while injecting a primary fuel and a combustible, hydrogen-containing gaseous product, comprising:

injecting into the engine the combustible, hydrogen-containing gaseous product while injecting a liquid fuel as the primary fuel into the engine and, while injecting the gaseous product, continually monitoring output signal magnitudes from a first sensor representative of a first variable relating to operation of the engine;

based on the monitored first sensor output signal magnitudes, deriving second signal magnitudes by imparting a shift to each in a plurality of first sensor output signal magnitudes, wherein the second signal magnitudes vary temporally as a function of change in the first sensor output signal magnitudes, and each in a plurality of second signal magnitudes is different than a first sensor output signal magnitude from which it is derived; and adjusting one or more engine parameters based in part on the second signal magnitudes.

2. The method of claim 1 wherein the adjusting step includes adjusting one or more of the following parameters: primary fuel flow rate, flow rate of the hydrogen-containing gaseous product and the mass air flow rate.

3. The method of claim 1 wherein the step of adjusting includes adjusting both the primary fuel flow rate and the flow rate of the hydrogen-containing gaseous product.

4. The method of claim 1 wherein the primary fuel is a liquid fuel and the first variable is indicative of a fuel manifold pressure, an air intake manifold pressure, a barometric pressure or an exhaust pressure.

5. The method of claim 1 wherein the engine includes an intake manifold and the adjusting step includes increasing flow of the hydrogen-containing gaseous product into the intake manifold as the engine power increases.

6. The method of claim 1 wherein the adjusting step improves engine fuel efficiency or lowers $NO_x$ emissions while the hydrogen-containing gaseous product is being injected.

7. The method of claim 1 wherein the first sensor output signal is provided as a series of first analog signals having first magnitudes and, prior to performing the step of adjusting, the step of monitoring the first sensor output signal includes:

digitizing the first analog signals to provide a series of first digital signals defining a series of first digital magnitudes representative of the first magnitudes; and modifying the first digital magnitudes to provide a series of second digital signals defining a series of second digital magnitudes representative of a series of second analog signal magnitudes different from the series of first analog signal magnitudes.

8. The method of claim 7 wherein the step of monitoring includes converting the second digital magnitudes into a series of second analog signals representative of the second analog signal magnitudes.

9. The method of claim 8 wherein the step of adjusting includes inputting the second digital signal or the second analog signal to an electronic control module which outputs a control signal to perform adjusting of an engine parameter.

10. The method of claim 3 wherein the step of adjusting includes generating the second signal magnitude as a function of a continually measured second variable.

11. The method of claim 10 wherein the function is a difference between the continually measured second variable and a predetermined value.

12. The method of claim 11 wherein the step of adjusting modifies the rate of primary fuel delivery into the engine to reduce the difference between measured values of the second variable and the predetermined value.

13. The method of claim 12 wherein the step of adjusting is performed with a control loop that limits $NO_x$ emissions during dynamically varying engine operating conditions based on changes in values of the second variable while the gaseous product is being injected into the engine.

14. The method of claim 13 wherein, with the gaseous product being injected into the engine, the step of adjusting is performed with a control loop that, in response to dynamically varying engine operating conditions, provides a ratio of air to primary fuel greater than the optimum ratio of air to primary fuel which would be had when optimizing fuel efficiency or minimizing $NO_x$ emissions without injection of any combustible, hydrogen-containing gaseous product into the engine.

15. For use in an electronic system which controls timing and metering of fuel delivered for combustion in an internal combustion engine, the electronic system including one or more sensors, including one first sensor for measuring an engine operating parameter and a processor unit which operates with software to provide command signals, based on magnitudes of measurements provided by the one first sensor, to control settings for engine operation, an electronic subsystem for connection between the one first sensor and the processor unit configured for:

(i) receiving from the one first sensor first analog signals having first analog magnitudes;

(ii) generating a first plurality of first digital signal magnitudes each representative of a first magnitude received from the one first sensor; and (iii) modifying the first digital signal magnitudes to generate a second plurality of second digital signal magnitudes by imparting magnitude shifts to each in the first plurality of the first digital signal magnitudes, each shift between a second digital signal magnitude and the first digital signal magnitude from which it is derived providing an input adjustment to the first digital signal magnitude suitable for the processor unit to use, in lieu of the first analog signal magnitudes, to generate an output to control engine operation by adjusting an engine parameter setting.

16. The electronic subsystem of claim 15 wherein circuitry, with which each shift between a second digital signal magnitude and the first digital signal magnitude from which it is derived provides the input adjustment, also converts the second digital signal to a second analog signal magnitude as an input for the processor unit.

17. The electronic subsystem of claim 16 wherein the second analog signal magnitude is provided as an input for the processor unit in lieu of the first analog signal magnitude.

18. The electronic subsystem of claim 15 wherein the shift by which each in the second plurality of second digital signal magnitudes is derived is representative of a second analog signal magnitude different from the first analog signal magnitude from which it is derived, the difference between the first analog signal magnitude and the second analog signal magnitude providing an adjusted magnitude for input to the processor unit to create an adjusted command signal relative to that which would result from input of the first analog signal magnitude to the processor unit.

19. In an electronic system which controls timing and metering of a primary fuel delivered for combustion in an internal combustion engine, the system including one or more sensors for measuring engine operating parameters, and a processor unit which operates with software to provide outputs based on sensor output signal magnitudes to control settings for engine operation, an electronic subsystem, comprising:

first circuitry for connection between a first sensor and the processor unit to receive first signals having first signal magnitudes from the first sensor, and generating second signals having second signal magnitudes each derived from a different one of the first signal magnitudes provided by the first sensor by imparting a shift to each in a plurality of the different ones of the first sensor output signal magnitudes, the second signal magnitudes provided for input to the processor unit in lieu of the plurality of the first sensor output signal magnitudes, each shift between a first magnitude and a second magnitude providing for an engine adjustment to an output from the processor unit.

20. The electronic subsystem of claim 19 wherein:

when the second signal magnitudes are provided to the processor, the primary fuel flow rate is adjusted; and the first circuitry provides a third signal for control of the flow rate of the hydrogen-containing gaseous product into the engine.

21. The electronic subsystem of claim 19 wherein:

the first signals are first analog signals and the second signals are second analog signals; and the first circuitry:

(i) generates first digital signals defining first digital magnitudes representative of the first analog signal magnitudes;

(ii) modifies each of the first digital signals to generate a second digital signal defining a second digital magnitude representative of one of the second analog signal magnitudes; and (iii) converts the second digital signal magnitudes into the second analog signal magnitudes for input to the processor unit.

22. The electronic subsystem of claim 21 wherein the sensor is a manifold pressure sensor and the subsystem is connected between the sensor and the processor unit to provide the second analog signal magnitudes to the processor unit to adjust data acquired from the manifold pressure sensor and improve engine fuel efficiency or reduce $NO_x$ emissions while a combustible, hydrogen-containing gaseous product is input to a combustion chamber of the engine.

23. The electronic subsystem of claim 19 wherein the second magnitudes are determined based on one or more predefined offset values to adjust the rate of flow of the primary fuel to improve performance of the engine when the combustible, hydrogen-containing gaseous product is present in the combustion chamber of the engine.

24. The electronic subsystem of claim 19 wherein the subsystem is connected between the sensor and the processor unit and the second signal magnitudes are provided to the processor unit in place of the first signal magnitudes.

25. A subsystem for use in combination with an electronic system in an internal combustion engine while the engine operates with a primary first fuel, the electronic system including one or more sensors to provide measurement signals for monitoring changes in one or more engine operating parameters and a processor unit configured to provide outputs, based in part on the measurement signals, to control timing and metering of the liquid fuel for delivery into one or more cylinders of the engine, or to control a fuel-to-air ratio, during engine operation, the subsystem comprising:

$NO_x$ circuitry, for connection between a first of the sensors and the processor unit, comprising first circuitry and programmed to continually adjust an engine parameter to limit output of $NO_x$ while a variable amount of reactive hydrogen is being provided for combustion with the primary fuel and while the engine operates under dynamically varying conditions wherein, in response to receiving first measurement signals from the first sensor, the first circuitry provides second measurement signals to the processor unit in lieu of the first measurement signals, the second measurement signals generated by continually imparting magnitude shifts to the first measurement signals as engine operating conditions vary.

* * * * *